United States Patent [19]

Baldauf

[11] Patent Number: 4,838,023

[45] Date of Patent: Jun. 13, 1989

[54] FLUID PRESSURE CIRCUIT WITH ACCUMULATOR CHARGING AND SAFETY VALVE SYSTEM INCLUDING CHECK VALVE BYPASS

[75] Inventor: Karl E. Baldauf, Saarbrucken, Fed. Rep. of Germany

[73] Assignee: Gesellschaft Fur Hydraulik-Zubehor mbH, Fed. Rep. of Germany

[21] Appl. No.: 40,137

[22] Filed: Apr. 20, 1987

[30] Foreign Application Priority Data

Apr. 23, 1986 [DE] Fed. Rep. of Germany ..... 3613689

[51] Int. Cl.[4] ..... F15B 1/02; F15B 20/00

[52] U.S. Cl. ..... 60/413

[58] Field of Search ..... 60/413, 414, 415, 416, 60/417, 418

[56] References Cited

U.S. PATENT DOCUMENTS

| | | | |
|---|---|---|---|
| 3,922,854 | 12/1975 | Coeurderoy | 60/413 |
| 3;963,039 | 6/1976 | Coeurderoy | 60/413 X |
| 3,991,570 | 11/1976 | Keller | 60/413 |
| 4,085,587 | 4/1979 | Garlinghouse | 60/413 X |
| 4,204,584 | 5/1980 | DeMaight | 60/413 X |
| 4,332,270 | 6/1982 | Budecker | 60/418 X |
| 4,353,286 | 10/1982 | Wetter | 60/413 X |
| 4,430,859 | 2/1984 | Hirsch | 60/413 X |
| 4,646,518 | 3/1987 | Hochsattel | 60/413 X |
| 4,723,412 | 2/1988 | Buschmann | 60/418 |

FOREIGN PATENT DOCUMENTS

| | | | |
|---|---|---|---|
| 2364413 | 7/1975 | Fed. Rep. of Germany | 60/413 |
| 3227776 | 10/1983 | Fed. Rep. of Germany . | |
| 7901395 | 8/1980 | Netherlands | 60/416 |
| 2089435 | 6/1982 | United Kingdom | 60/413 |

*Primary Examiner*—Robert E. Garrett
*Assistant Examiner*—George Kapsalas
*Attorney, Agent, or Firm*—Roylance, Abrams, Berdo & Goodman

[57] ABSTRACT

A safety system connecting a pressure medium source, user, and a pressure reservoir (accumulator) has a pressure port, a supply container port, a reservoir port, a three-way valve and a pressure relief valve. The pressure relief valve is attached to the pressure port and to the three-way valve. The valve member of the three-way valve in a first position connects the pressure port with the reservoir port. In a second position, the valve member connects the reservoir port with the supply container port. To avoid the disadvantages of a three-way valve with negative overlap, an arrester check or anti-return valve is inserted between the pressure port and the reservoir port closing toward the reservoir port. The three-way valve has a positive overlap.

14 Claims, 2 Drawing Sheets

FLUID PRESSURE CIRCUIT WITH ACCUMULATOR CHARGING AND SAFETY VALVE SYSTEM INCLUDING CHECK VALVE BYPASS

BACKGROUND OF THE INVENTION

1. Field of the Invention

The present invention relates to a safety system for connecting a pressure medium source, a user of the pressure of the pressure source, and a pressure reservoir.

2. Description of the Prior Art

With a known safety device for connecting a pressure source, user and pressure reservoir, the three-way valve has a negative overlap. Such valve, especially a ball cock assembly, is not tight due to imprecise connections and/or insufficiently precise finishing, permitting pressure medium to penetrate through this valve, even when the valve is closed. If the reservoir line is of lower resistance than the line to the supply container, and the leakage penetrates from the closed three-way valve to the empty reservoir. This is a particular disadvantage when the pressure reservoir is removed. Such system is disclosed in DE-PS No. 32 27 776.

One known valve device is configured as four-part valve with three user connections, which should be fed pressure medium in a special way from a pressure medium source. With the known valve device, an arrester valve closing in the direction of the reservoir port is connected to a passage connecting the pressure port and the reservoir port. One of the users is attached in the passage connecting the pressure port with the arrester valve. An additional arrester valve, opening in the direction of the user, is arranged in this passage before this user. Such system is disclosed in DE-OS No. 29 35 949.

SUMMARY OF THE INVENTION

An object of the present invention is to provide a safety system which improves the present state of the art and avoids the disadvantages of a three-way valve with negative overlap.

Another object of the present invention is to provide a safety system for hydraulic circuits, which avoids risks due to improper connection, is compact, is inexpensive to manufacture and has a minimum of individual parts.

The foregoing objects are obtained by a safety system for connecting a pressure medium source, a user and a pressure or hydraulic accumulator. The system comprises a user port for attaching the user, a pressure port for attaching the pressure medium source, a supply port for attaching a fluid tank, and a reservoir port for attaching a pressure or hydraulic accumulator. A three-way valve having a positive overlap is coupled by passages with each port. The three-way valve is movable between a first position connecting the pressure port with the pressure accumulator port and a second position connecting the pressure accumulator port with the tank port. A pressure relief valve is provided in the passage coupling the pressure port and the three-way valve. An check or anti-return valve is provided in the passage connecting the pressure port and the accumulator port. The user port and the relief valve are attached to the passage coupling the pressure port with the check or anti-return valve. The three-way valve is attached to the passage coupling the check or anti-return valve and said reservoir port.

With use of an check or anti-return valve in special connections, a three-way valve with positive overlap can be used. For numerous cases, fusing of the hydraulic circuit can be avoided with use of the safety system according to the present invention. Even in the case of wrong connections, there is no risk to safety. The safety system according to the present invention is of compact structure. It is produced at low cost and with a minimum of individual parts. The pressure accumulator is always connected with the safety or relief valve or with the discharge connection, so that no undue pressure can build-up. The user is always protected by the pressure relief valve.

The check or anti-return valve can have a larger flow through diameter than the three-way valve. The larger section of the check or anti-return valve, as compared with the three-way valve, serves for rapid discharge and emptying of the pressure reservoir, if pressure medium is to be discharged rapidly from the pressure reservoir to the user. The smaller flow through section in the three-way valve is sufficient for the loading and its connection with the supply container is adequate for its unloading. A three-way valve, especially a ball cock valve, will generally hold more tightly with a small flow through section than with large flow through section. It is of low cost and needs only a small space.

As small as possible resistance to the flow of pressure medium from the pressure reservoir to the user is obtained by the use of a straight passage therebetween. The user gets pressure medium both from the pressure reservoir and from the pressure medium source.

A pressure reservoir mounting coupled to the three-way valve can increase the safety upon removal of the pressure reservoir from the safety system.

Sudden draining of the pressure reservoir into the supply container can be avoided by a constriction between the pressure reservoir and the supply container. A liquid surge into the supply container there would lead to undesirable raising up of the dirt.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS OF THE INVENTION

Figure 1:
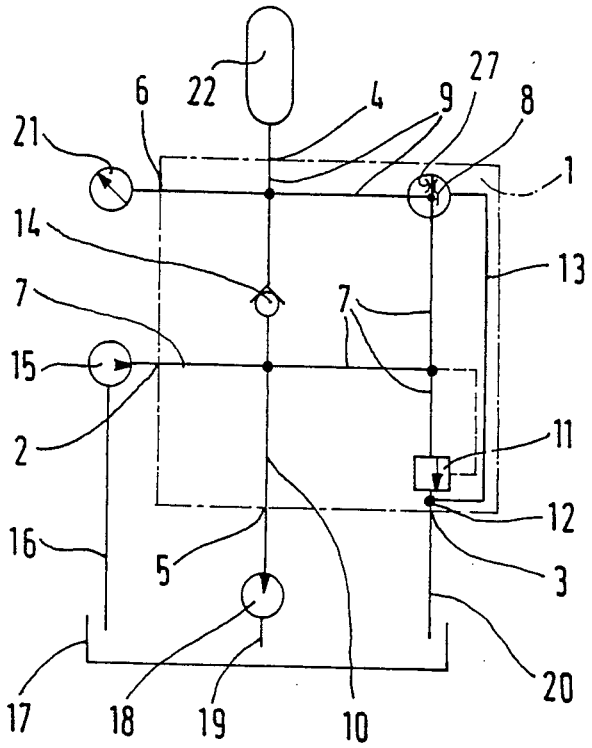
FIG. 1 is a diagrammatic view of a safety system for connecting a pressure medium source, user and pressure reservoir according to a first embodiment of the present invention.

The safety system device of FIG. 1 comprises a housing 1 diagrammatically represented in broken lines. The housing has a pressure port or connection 2, a supply container port or connection 3, a reservoir port or connection 4, a user port or connection 5 and a measuring point port or connection 6. Pressure port 2 is connected through a pressure passage 7 with a three-way valve 8, configured as ball cock assembly and having a positive overlap. Three-way valve 8 is connected through a reservoir passage 9 with the reservoir port 4. The user port 5 is connected through user passage 10 with the pressure passage 7. A relief valve 11 is connected to a pressure passage 7, and to supply container port 3 through discharge passage 12. A connection passage 13 connects the three-way valve 8 with the discharge passage 12.

Three-way valve 8 has a valve member, which, in the rotary position shown in FIG. 1, connects pressure passage 7 with reservoir passage 9 and separates connection passage 13 from passages 7 and 9. In a different or second rotary position of valve member of three-way valve 8, the reservoir passage 9 is connected with connection 13, and pressure passage 7 is separated from passages 9 and 13. In a third rotary position of the valve member of three-way valve 8, pressure passage 7 is connected through a constriction point 27 with connection passage 13, and thus, with discharge passage 12; and reservoir passage 9 is separated from passages 7 and 13. In a fourth rotary position of the valve member of three-way valve 8, pressure passage 7 and reservoir passage 9 are both connected with connection passage 13.

Pressure passage 7 and reservoir passage 9 are connected with each other through an arrester valve 14 open to the pressure passage 7. Check or anti-return valve 14 has a larger flow through section than three-way valve 8. The ratio of the two flow through sections is preferably between about 2:1 and about 5:1.

A pressure medium source 15 is attached to pressure port and connected through a suction passage 16 with a supply container 17. User port 5 is connected with a user 18, which user is connected through a discharge passage 19 with supply container 17. Supply container port 3 is connected by a discharge passage 20 to supply container 17. A pressure measuring device 21 is attached to measuring port 6. A pressure reservoir 22 is coupled to the reservoir port 4. Pressure reservoir 22 is preferably configured as hydropneumatic accumulator or "bladder type" reservoir.

As noted above, check or anti-return valve 14 has a flow through section considerably larger than that of three-way valve 8. The larger section of arrester valve 14 and the passages which connect pressure reservoir 22 with user 18, serve in emergency for the rapid flow through of pressure medium from pressure reservoir 22 to user 18. Three-way valve 8 suffices as a shunt. The cross section of three-way valve 8 suffices for the loading of pressure reservoir 22 by pressure medium source 15 and unloading of the pressure reservoir 22 into supply container 17. Three-way valve 8 must then be especially tight, if reservoir passage 9 is separated from pressure passage 7. In order to keep the resistance against the flow of pressure medium in the passages between reservoir port 4 and user port 5 as low as possible, these passages are preferably configured in a straight line.

With the valve member of three-way valve 8 as shown in FIG. 1, pressure medium source 15 conveys pressure medium both to user 18 and into pressure reservoir 22. Pressure line 7 is kept safe by pressure relief valve 11. In a second position of the valve member of three-way valve 8, pressure reservoir 22 is separated from the discharge of pressure passage 7 and is connected directly with the supply container 17. In a third position of the valve member, pressure passage 7 is connected with connection passage 13, and with supply container 17 through the discharge passage 20. Constriction 27 allows a measured slow discharge of reservoir 22 independent of the change speed of the three-way valve. In the fourth position of the valve member of three-way valve 8, pressure passage 7 and reservoir passage 9 are both connected with connection passage 13.

Pressure medium source 15 and user 18 are still secure, regardless of position of the valve member of three-way valve 8 because of pressure relief valve 11. Security of the pressure reservoir 22 separated from pressure passage 7 and connection passage 13 is attained by arrester valve 14, which arrester valve connects reservoir passage 9 with pressure passage 7, and thus, with pressure relief valve 11. This also serves in the intermediate space of the valve member of three-way valve 8 for the security of pressure medium source 15, user 18 and pressure reservoir 22.

If three-way valve 8 is configured as a three-way ball cock, its angle of rotation can be limited as required.

Figure 2:
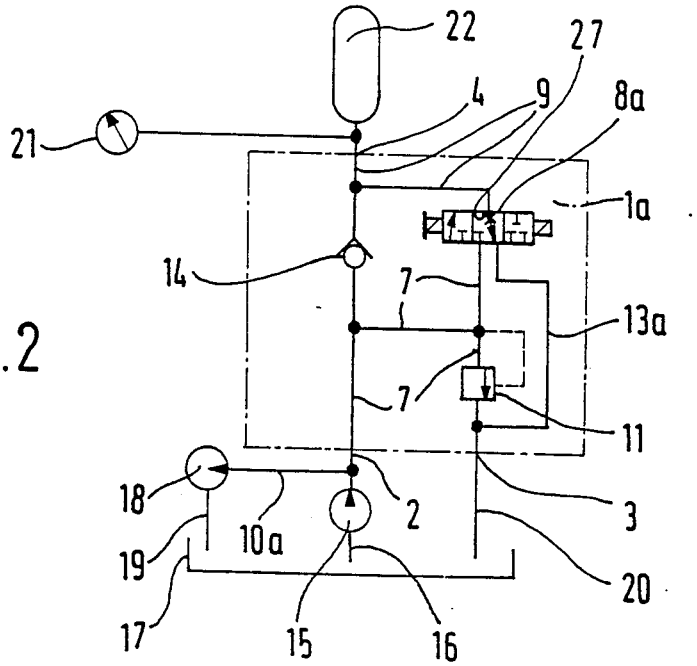
FIG. 2 is a diagrammatic view of a safety system for connecting a pressure medium source, a user and a pressure reservoir according to a second embodiment of the present invention.

In the embodiment of FIG. 2, the same parts are provided with the same references, and the reference for modified parts have the letter a added. The diagrams of FIGS. 1 and 2 differ essentially by the position change of user port 5 and measuring port 6, since the user passage **10*a* is attached outside housing 1*a* to the back of pressure medium source 15. Pressure measuring device 21 is likewise connected outside housing 1*a* with pressure reservoir 22**.

Three-way valve **8*a* is configured as 3/3 valve with electric operation and with operation by manual force in emergency for discharging reservoir 22. In the control position of the valve member of three-way valve 8*a* as shown in FIG. 2, pressure reservoir 22 is connected with supply container 17 through constriction point 27. In a second control position of this valve member, pressure reservoir 22 is connected with pressure medium source 15. In a third control position of this valve member, pressure reservoir 22 is separated both from pressure medium source 15 and from supply container 17. A connection between pressure reservoir 22 and pressure relief valve 11 is also present in this embodiment through arrester valve 14. Since pressure medium source 15 is separated from reservoir 22, only pressure medium source 15 conveys pressure to user 18**.

Figure 3:
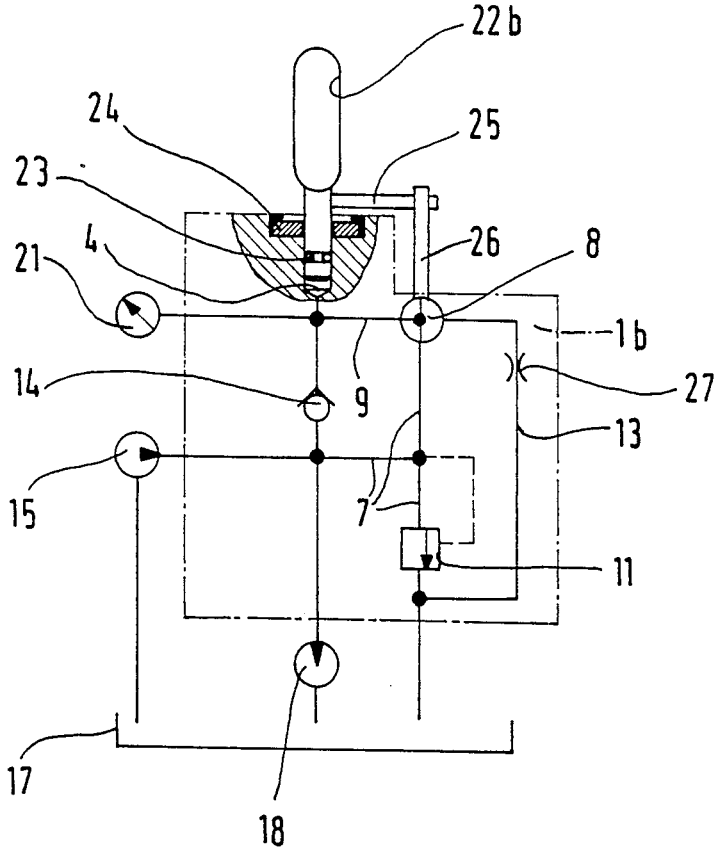
FIG. 3 is a diagrammatic view of a safety system for connecting a pressure medium source, user and pressure reservoir according to a third embodiment of the present invention.

In the third exemplary embodiment of FIG. 3, the set of connections of the first exemplary embodiment of FIG. 1 corresponds to those in FIG. 3, except constriction point 27 is not arranged in three-way valve 8. Constriction point 27 is located in line 13 in FIG. 3. Pressure reservoir **22*b* is attached to housing 1*b* by means of a packing ring 23 sealing the clearance between reservoir port 4 in housing 1*b* and the reservoir. The coupling is configured as a plug connection. For installation of pressure reservoir 22*b* in housing 1*b*, a diagrammatically represented bayonet coupling 24 is shown, which bayonet coupling has an opening or closing angle of about 90 degrees. A radially projecting lever 25 is mounted on the bayonet coupling of pressure reservoir 22*b*. The bayonet coupling can open or close lever 25. The valve member of the three-way valve 8, configured as a ball cock assembly and offset 90 degrees in FIG. 3, is connected with a connection lever 26, which connection lever can be moved perpendicular to the plane of the drawing and cooperates with reservoir lever 25. The entire assembly is arranged so that, upon opening of bayonet coupling 24 connecting pressure reservoir 22***b* to housing 1*b*, connection lever 26 operates the valve 8 such that reservoir passage 9 is connected through connection passage 13 with supply container 17 and is separated from pressure passage 7. A connection is already present between reservoir passage 9 and connection passage 13, when the bayonet coupling is rotated through an angle of about 30 degrees. After release of the bayonet coupling 24, the plug-like connection between reservoir 22*b* and housing 1*b* is released and pressure reservoir 22*b* can be removed from housing 1*b*.

The described system with levers 25 and 26 prevents the pressure reservoir 22*b* from remaining under pressure from pressure medium source 15 upon the removal of pressure reservoir 22 from housing 1*b*. The operation of the valve of three-way valve 8 is not prevented by reservoir lever 25, if a connection is produced between pressure medium source 15 and reservoir 22*b* or supply container 17. This also functions when pressure medium source 15 and reservoir 22*b* are to be connected with supply container 17.

Instead of levers 25 and 26, another rod assembly with the same effect can be provided. The constriction 27 can also be deleted.

While various embodiments have been chosen to illustrate the invention, it will be understood by those skilled in the art that various changes and modifications can be made therein without departing from the scope of the invention as defined in the appended claims.

What is claimed is:

1. A safety system for connecting a pressure medium source, a user and a pressure accumulator, comprising:

user port means for attaching the user;

pressure port means for attaching the pressure medium source;

supply port means for attaching a fluid supply container;

accumulator port means for attaching the pressure accumulator;

a three-way valve having a positive overlap and coupled by passages with each of said port means, said three-way valve being movable between a first position connecting said pressure port means with said accumulator port means and a second position connecting said accumulator port means with said supply port means;

a pressure relief valve connected to a passage coupling said pressure port means and said three-way valve;

a check valve in a passage connecting said pressure port means and said accumulator port means, said user port means and said relief valve being connected to a passage coupling said pressure port means with said check valve, said three-way valve being connected to a passage coupling said check valve, said user port means and said accumulator port means so as to bypass said check valve.

2. A safety system according to claim 1 wherein said check valve is mounted in a straight passage connecting said accumulator port means and said user port means.

3. A safety system according to claim 1 wherein the passage coupling said accumulator port means and said supply port means comprises a constriction.

4. A safety system according to claim 1 wherein said check valve has a larger flow-through diameter than said three-way valve.

5. A safety system according to claim 4 wherein said check valve is mounted in a straight passage connecting said accumulator port means and said user port means.

6. A safety system according to claim 1 wherein said accumulator port means is in a housing and tightly receives the pressure accumulator in the housing with a turning lock, a rod being coupled to said turning lock such that rotation of said turning lock for removing the pressure accumulator from said housing must break connection between said pressure port means and said accumulator port means.

7. A safety system according to claim 6 wherein said rod is mounted on said pressure accumulator, and comprises an accumulator lever projecting laterally for releasing said turning lock and a connection lever coupled with a valve member of said three-way valve, said connection lever cooperating with said accumulator lever.

8. A safety system for connecting a pressure medium source, a user and a pressure accumulator, comprising:

user port means for attaching the user;

pressure port means for attaching the pressure medium source;

supply port means for attaching a fluid supply container;

accumulator port means for attaching the pressure accumulator;

a three-way valve having a positive overlap and coupled by a first passage to said accumulator port means, by a second passage to pressure port means, by a third passage to said user port means and by a fourth passage to said supply port means, said three-way valve being movable between a first position connecting said pressure port means with said accumulator port means and a second position connecting said accumulator port means with said supply port means;

a pressure relief valve connected to said second passage;

a check valve in a fifth passage connecting said accumulator port means with said pressure port means and said user port means and bypassing said three-way valve, said relief valve and said three-way valve being connected to said fifth passage between said pressure port means, said user port means and said check valve.

9. A safety system according to claim 8 wherein said check valve is mounted in a straight passage connecting said accumulator port means and said user port means.

10. A safety system according to claim 8 wherein a passage couples said accumulator port means and said supply port means, and comprises a constriction.

11. A safety system according to claim 8 wherein said check valve has a larger flow through diameter than said three-way valve.

12. A safety system according to claim 11 wherein said check valve is mounted in a straight passage connecting said accumulator port means and said user port means.

13. A safety system according to claim 8 wherein said accumulator port means is in a housing and tightly receives the pressure accumulator in the housing with a turning lock, a rod being coupled to said turning lock such that rotation of said turning lock for removing the pressure accumulator from said housing must break connection between said pressure port means and said accumulator port means.

14. A safety system according to claim 13 wherein said rod is mounted on said pressure accumulator, and comprises an accumulator lever projecting laterally for releasing said turning lock and a connection lever coupled with a valve member of said three-way valve, said connection lever cooperating with said accumulator lever.

* * * * *